US012546307B2

(12) United States Patent
Kowalski et al.

(10) Patent No.: US 12,546,307 B2
(45) Date of Patent: Feb. 10, 2026

(54) FRACTURING PUMP PINION ROTATION ASSEMBLY

(71) Applicant: BEST PUMP AND FLOW, LLC, Willow Park, TX (US)

(72) Inventors: Christopher Kowalski, Fort Worth, TX (US); Eduardo Torres, Fort Worth, TX (US); Jeffrey Plaisted, Fort Worth, TX (US)

(73) Assignee: BEST PUMP AND FLOW, LLC, Willow Park, TX (US)

( * ) Notice: Subject to any disclaimer, the term of this patent is extended or adjusted under 35 U.S.C. 154(b) by 0 days.

(21) Appl. No.: 18/438,700

(22) Filed: Feb. 12, 2024

(65) Prior Publication Data

US 2025/0257725 A1 Aug. 14, 2025

(51) Int. Cl.
*F04B 53/04* (2006.01)

(52) U.S. Cl.
CPC ..... *F04B 53/04* (2013.01)

(58) Field of Classification Search
CPC ..... F04B 53/04; F04B 9/14
See application file for complete search history.

(56) References Cited

U.S. PATENT DOCUMENTS

| | | | | |
|---|---|---|---|---|
| 10,190,718 | B2 | 1/2019 | Weinstein | |
| 10,227,854 | B2 | 3/2019 | Glass | |
| 11,009,024 | B1 | 5/2021 | Buckley | |
| 11,168,681 | B2 | 11/2021 | Boguski | |
| 11,643,915 | B2 | 5/2023 | Yeung et al. | |
| 11,686,305 | B2 | 6/2023 | Buckley | |
| 2004/0126255 | A1* | 7/2004 | Kuramoto | F04C 28/06 417/423.6 |
| 2009/0016919 | A1* | 1/2009 | Mitchell | F04C 2/18 418/161 |
| 2014/0147291 | A1 | 5/2014 | Burnette | |
| 2017/0370525 | A1 | 12/2017 | Hester | |
| 2021/0108624 | A1* | 4/2021 | Price | F04B 53/16 |
| 2022/0220952 | A1 | 7/2022 | Louzon | |

* cited by examiner

*Primary Examiner* — Minnah L Seoh
*Assistant Examiner* — Gregory T Prather
(74) *Attorney, Agent, or Firm* — Abel Schillinger, LLP

(57) ABSTRACT

A fracturing pump pinion rotation assembly has a stem having a portion adapted to be threaded to or bolted to a non-drive side of the pinion shaft, and a cover having an opening therein. The stem has a socket or extension adapted to be manipulated by a tool such that the rotation of the stem causes a corresponding rotation of the pinion shaft. The cover is adapted to be affixed to a wall of a non-drive side of the fracturing pump. The opening overlies the socket or extension of the stem such that the socket or extension is accessible from an exterior of the fracturing pump. A cap is removably or pivotally connected to an end of the annular portion of the cover.

16 Claims, 7 Drawing Sheets

FRACTURING PUMP PINION ROTATION ASSEMBLY

FIELD OF THE INVENTION

The present invention relates to fracturing pumps. The present invention further relates to the pinion used in a fracturing pump. More particularly, the present invention relates to a fracturing pump pinion rotation assembly whereby the pinion can be rotated from an exterior of the fracturing pump.

BACKGROUND OF THE INVENTION

It is difficult to economically produce hydrocarbons from low-permeability reservoir rocks. Oil and gas production rates are often boosted by hydraulic fracturing, a technique that increases rock permeability by opening channels through which hydrocarbons can flow to recovery wells. Hydraulic fracturing has been used for decades to stimulate production from conventional oil and gas wells. The practice consists of pumping fluid into a wellbore at high-pressure (sometimes as high as 50,000 p.s.i.). Large quantities of proppants are carried in suspension by the fracture fluid into the fractures. When the fluid enters the formation, it fractures, or creates fissures, in the formation. Water, as well as other fluids, and some solid proppants, are then pumped into the fissures to stimulate the release of oil and gas from the formation. When the pressure is released, the fractures partially closed on the proppants, leaving channels for oil and gas to flow.

Fracturing rock in a formation requires that the fracture fluid be pumped into the wellbore at very high pressures. This pumping is typically performed by high-pressure, hydraulic fracturing pumps. This pumping is carried out with the diesel engine used to power the operation of the pump in order to deliver fracture fluids at sufficiently high flow rates and pressures to complete a hydraulic fracturing procedure or "frac job". These pumps are generally comprised of a power end and a fluid end. The fluid end of such a pump that is utilized to pressurize a working fluid may include a fluid suction manifold, a fluid discharge manifold, a fluid cylinder and a plunger. The power end of such a pump may include a crankcase in which a crankshaft is rotated in order to drive a plurality of piston arms. These piston arms in turn reciprocate crossheads. These crossheads are attached to the plungers of the fluid end to drive the plungers within the fluid cylinder. A power source, such as a diesel engine, is utilized to drive the crankshaft via a pinion shaft having a pinion gear integrally formed at each end. Each pinion gear, in turn, engages a separate bull gear carried on the crankshaft and secured on the crankshaft by a key joint. The key joint of the bull gear may be manipulated to adjust for backlash between the meshed gears.

Generally, the power end of a hydraulic fracturing pump includes a crankcase in which is mounted a crankshaft, a pinion assembly, and one or more spaced apart intermediate assemblies. The pinion assembly extends along a pinion axis and has a first pinion shaft and a second pinion shaft coupled together by a coupler. Each pinion shaft includes an input pinion gear mounted on one end of the pinion shaft. The crankshaft is disposed along a crankshaft axis that is parallel with and spaced apart from the pinion axis and includes a crankshaft gear mounted on each end of the crankshaft. Each crankshaft gear is interconnected to the pinion gear by an intermediate gear assembly. Each intermediate gear assembly extends along an intermediate axis parallel with, but spaced apart from, the crankcase axis and the pinion axis. Each intermediate assembly has an intermediate shaft with a first intermediate gear meshed with a pinion gear and a second intermediate gear meshed with the bull gear. Rotation of the crankshaft drives a plurality of piston arms which, in turn, cause reciprocation of a plurality of crossheads mounted in the crankshaft housing. Each crosshead has a crosshead axis along with the crosshead reciprocates. Each crosshead axis is generally perpendicular to the crankshaft axis.

FIG. 1 shows a perspective view of a power end 10 of a hydraulic fracturing pump of the prior art. Power end 10 generally includes a crankcase 12 formed of a crankcase housing 14 extending along a crankcase axis 15. The crankcase housing 14 has a first end 16 and a second end 18 with a first side 20 enclosing the crankcase housing 14 at the first end 16 and a second side 22 enclosing the crankcase housing 14 at the second end 18. A gearbox assembly 24 may be attached to at least one of the ends 16, 18 of the crankcase housing 14. Each gearbox assembly 24 includes a gearbox housing 25 attached at first and second ends 16, 18. A first gearbox assembly 24*a* is attached to the first end 16 of crankcase 12 and a second gearbox assembly 24*b* is attached to the second end 18 of the crankcase 12. A plurality of crosshead extension rods 26 are shown extending from crankcase housing 14. A plurality of stay rods 28 may also extend from crankcase housing 14 generally adjacent to and parallel with crosshead extension rods 26.

The power end 10 includes a pinion assembly 30 having a pinion axis 32 and generally extending at least partially between the first side 20 and the second side 22 of crankcase housing 14. Pinion axis 32 is parallel with, but spaced apart from, the crankcase axis 15. The pinion assembly 30 may be coupled to a power source (not shown) to drive the power and 10.

The crankcase 12 may include one or more eye flanges 34. Each first side 20 includes a forward eye flange 34*a* and a rear eye flange 34*b*, and second side 22 likewise includes a forward eye flange 34*a* and a rear eye flange 34*b*. Crankcase 12 may further include one or more access covers 36. Five upper access covers 36*a* are shown. An oil port 37 is shown formed in gearbox housing 25.

FIG. 2 shows that the prior art has a crankshaft 40 extending along the crankcase axis 15 from a first crankshaft end 42 to a second crankshaft end 44. FIG. 2 illustrates additional details of the gearbox assembly 24 and the pinion assembly 30 of the prior art. Gearbox assembly 24 includes a crankshaft gear 46 mounted on each end 42, 44 of crankshaft 40. Crankshaft gear 46 is a bull gear. The first crankshaft gear 46*a* is mounted on the first end 42 of crankshaft 40 and a second crankshaft gear 46*b* is mounted on the second end 44 of the crankshaft 40.

Pinion assembly 30 is shown as having a first pinion shaft 50*a* and a second pinion shaft 50*b* extending along pinion axis 32 so as to be coaxial with one another. The first and second pinion shafts 50*a*, 50*b* are parallel with but spaced apart from crankcase axis 15. As such, first and second pinion shafts 50*a*, 50*b* may also pass through ribs 43. Ribs 43 may have apertures 45 through which first and second shafts 50*a*, 50*b* pass. Each pinion shaft has a first end 52 and a second end 54 with an input pinion gear 56 disposed along each pinion shaft 50 adjacent the first end 52 of each pinion shaft 50. Input pinion gear 56 is disposed along pinion shaft 50*a* and input pinion gear 56*b* is disposed along pinion shaft 50*b*. The pinion gear 56 may be integrally formed as part of the pinion shaft 50.

Pinion assembly 30 also includes a coupler 64 coupling together the first and second pinion shaft 50*a*, 50*b* at their respective second ends 54. Coupler 64 may have a first coupler portion 64*a* that can engage end 54 of pinion shaft 50*a* and a second coupler portion 64*b* can engage end 54 of pinion shaft 50*b*. This allows the two pinion shafts 50*a* and 50*b* to be coupled together.

During the maintenance of such frac pumps, mechanics have had to rotate the pump using a large pry bar inserted into the universal joint of the driveshaft connecting the transmission to the pump. This maintenance can include the changing of fluid end valves, plungers or other various tasks. This is an unsafe, difficult and usually damages the grease fittings on the universal joint. As such, a need has developed to be able to manipulate the pinion shaft from the exterior of the fracturing pump so that the pump to be easily turned using a ratchet or other tool that can engage with the pinion shaft.

In the past, various patents have issued relating to the pinion assembly used in such fracturing pumps. For example, U.S. Pat. No. 10,190,718, issued on Jan. 29, 2019 to Weinstein et al., teaches an accumulator assembly and a pump assembly having the accumulator assembly. The accumulator assembly is arranged to fluidically connect to a flowline between a blender and a fracturing pump of the pump system. The accumulator assembly includes a tank configuration to contain pressurized fluid and a control valve fluidically connected between a discharge end of the tank and the flowline. The control valve opens connects the tank to the flowline when a pressure on the flowline is less than a target pressure. The control valve closes and fluidically blocks communication between the tank and the flowline when the pressure on the flowline is greater than or substantially the same as the target pressure.

U.S. Pat. No. 10,227,854, issued on Mar. 12, 2019 to C. Glass, describes a pumping system for use in hydraulic fracturing. This pumping system is self-contained on a transportable system, such as a trailer. The system components include a diesel generator, a cooling radiator, a variable-frequency drive and a cooling system. An AC induction motor and a high capacity pump are also provided in the system.

U.S. Pat. No. 11,009,024, issued on May 18, 2021 to C. P. Buckley, shows a hydraulic fracturing pump that includes a power end with a plurality of torsion tubes extending between sides of a crankcase housing in which a crankshaft is rotatably mounted. The crankshaft is coupled by piston arms to crossheads disposed to reciprocate along crosshead axes that are perpendicular to the crankshaft. A plurality of ribs generally perpendicular to the crankshaft are disposed within the crankcase housing. This plurality of ribs extend from the base of the crankshaft housing to an upper surface of the crankshaft housing. The torsion tubes are generally adjacent the upper surface of the crankcase housing and pass perpendicular through each of the plurality of ribs that are attached to the ribs provide rigidity to the power end.

U.S. Pat. No. 11,168,681, issued on Nov. 9, 2021 to Boguski et al., teaches a drive system for a hydraulic fracturing pump. This hydraulic fracturing pump includes a pinion assembly extending along a pinion axis and mounted in a crankcase. The pinion assembly has a first pinion shaft and a second pinion shaft coupled together by a keyless coupler. Each pinion shaft includes an input pinion gear mounted at one end of the pinion shaft. A crankshaft is disposed along a crankshaft axis and is mounted in the crankcase parallel with but spaced from the pinion axis. The crankshaft includes a bull gear mounted on each end of the crankshaft with each bull gear interconnected to an input pinion gear by an intermediate gear assembly. Each intermediate gear assembly extends along an intermediate axis parallel with, but spaced apart from, the crankcase and pinion axis. Each intermediate assembly has an intermediate shaft with a first intermediate gear meshed with a pinion gear and a second intermediate gear meshed with the bull gear.

U.S. Pat. No. 11,643,915, issued on Mar. 9, 2023 to Yeung et al., describes drive equipment for mobile hydraulic fracturing power units. The mobile power units include a gas turbine engine that provides mechanical power to a driveshaft which is connected to the drive equipment such that the drive equipment is driven by the engine. The drive equipment can include a hydraulic fracturing pump or an electrical generator. The driveshaft is rotated at a speed suitable for the hydraulic fracturing pump and the electrical generator includes a step-up gearbox to increase a rotational speed of the driveshaft for use by the electrical generator.

U.S. Pat. No. 11,686,305, issued on Jun. 27, 2023 to C. P. Buckley, teaches a hydraulic fracturing pump including a power end with a plurality of torsion tubes extending between sides of a crankcase housing in which a crankshaft is rotatably mounted. The crankshaft is coupled by piston arms to crossheads disposed to reciprocate along crosshead axes that are perpendicular to the crankshaft. A plurality of ribs are disposed within the crankcase housing generally perpendicular to the crankshaft and extend from the base of the crankshaft housing to an upper surface of the crankshaft housing. The torsion tubes are generally adjacent the upper surface of the crankcase housing and pass perpendicularly through each of the plurality of ribs and are attached to the ribs to provide rigidity to the power end.

U.S. Patent Application Publication No. 2014/0147291, published on May 29, 2014 to B. C. Burnette, describes a reciprocating pump assembly that includes a first fluid assembly, a second fluid assembly, and a power assembly operable by a prime mover. The prime mover includes either an engine or a motor. The power assembly is interposed between and shared by the first fluid assembly and the second fluid assembly. The power assembly includes at least one rotatable crankshaft operating the first and second fluid assemblies.

U.S. Patent Application Publication No. 2017/0370525, published on Dec. 28, 2017 to B. Wagner, provides a power frame and lubrication system for a reciprocating pump assembly. The reciprocating pump assembly includes a block having bores formed therethrough and crossheads disposed in the bores and adapted to reciprocate therein. A lubrication pump is in fluid communication with the bores. The pump is operable to pump lubrication fluid into each of the bores so that the crossheads are lubricated as they reciprocate within their respective bores. The power end includes a crosshead block and a power frame connected thereto. The frame includes rib plates and supporting the crosshead block.

U.S. Patent Application Publication No. 2022/0220952, published on Jul. 14, 2022 to M. I. Louzon, teaches a fracturing pump assembly that is reconfigurable on site. A closed-loop oil feed system provides constant and reliable lubrication under heavy loads. A sealing system is utilized so as to reduce leaks and thermal stresses.

It is an object of the present invention to provide a fracturing pump pinion rotation assembly that makes it easier to turn the pinion of the fracturing pump.

It is another object of the present invention to provide a fracturing pump pinion rotation assembly that is easily accessible.

It is another object of the present invention to provide a fracturing pump pinion rotation assembly that is very safe.

It is another object of the present invention to provide a fracturing pump pinion rotation assembly that can reduce on-site injuries to personnel.

It is another object of the present invention provide a fracturing pump pinion rotation assembly that is easy-to-use.

It is a further object of the present invention to provide a fracturing pump pinion rotation assembly that avoids damaging grease fittings associated with the pump assembly.

These and other objects and advantages of the present invention will become apparent from a reading of the attached specification and appended claims.

BRIEF SUMMARY OF THE INVENTION

The present invention is a fracturing pump pinion rotation assembly that comprises a stem having a portion adapted to be threaded to or bolted to a non-drive side of a pinion shaft, and a cover having an opening therein. The stem has a socket or an extension adapted to be manipulated by a tool such that the rotation of the stem causes a corresponding rotation of the pinion. The cover is adapted to be affixed to a wall of the non-drive side of the fracturing pump. The opening overlies the socket or extension of the stem such that the socket or extension is accessible from an exterior of the fracturing pump.

The cover has an annular portion extending outwardly away from the wall of the non-drive side of the fracturing pump. The opening of the cover is defined by an interior of the annular portion of the cover.

A cap is removably or pivotally connected to an end of the annular portion of the cover. The cap is movable between a first position covering the opening of the annular portion and a second position exposing the socket or extension of the stem through the opening of the annular portion of the cover. The annular portion of the cover has a bolt hole formed at an end thereof. The cap has a bolt hole formed adjacent a periphery of the cap. A shoulder bolt extends to the bolt hole of the cap and is affixed within the bolt hole of the annular portion of the cover. The cap is pivotable around the shoulder bolt so as to move between the first position and the second position.

A magnet is affixed to either a surface of the cap that faces the annular portion of the cover or to an end of the annular portion of the cover. The magnet is adapted to releasably affix the cap over the opening of the annular portion of the cover. In an embodiment of the present invention, the magnet comprises a plurality of magnets arranged in spaced relation to each other around the surface of the cap. In an alternative embodiment, the magnet comprises a plurality of magnets arranged in spaced relation at the end of the annular portion of the cover. An O-ring seal is positioned between the cap and the annular portion of the cover. The O-ring seal is adapted to seal the opening of the annular portion of the cover.

The stem has a narrow diameter portion and a wide diameter portion with a flange formed between the narrow diameter portion and the wide diameter portion. The narrow diameter portion of the stem has an end opposite the wide diameter portion of the stem that is adapted to engage with the pinion shaft. The wide diameter portion of the stem extends away from the pinion shaft. The flange bears against an end of the pinion shaft. The wide diameter portion of the stem extends into the opening of the cover.

A retaining seal is interposed between the wide diameter portion of the stem and the wall of the non-drive side of the fracturing pump. The rotary seal is adapted to allow the stem to rotate in relation to the wall of the non-drive side of the fracturing pump. The cover has a discoidal portion with an opening formed centrally through this discoidal portion. The discoidal portion has a plurality of holes formed in spaced relation radially outwardly of the opening of the cover. A plurality of fasteners extend through the plurality of holes to engage with the wall of the non-drive side of the fracturing pump.

In the preferred embodiment of the present invention, the socket or extension is a drive socket. This drive socket is adapted to be engageable with the tool. This tool can be either a wrench or a ratchet. In an embodiment of the present invention, the narrow diameter portion of the stem is threaded. In an alternative embodiment of the present invention, the narrow diameter portion is a pin. The cap is pivotally connected to the end of the annual portion of the cover. The cup is slidable along a shoulder bolt secured to the annular portion of the cover so as to separate from the annular portion of the cover.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
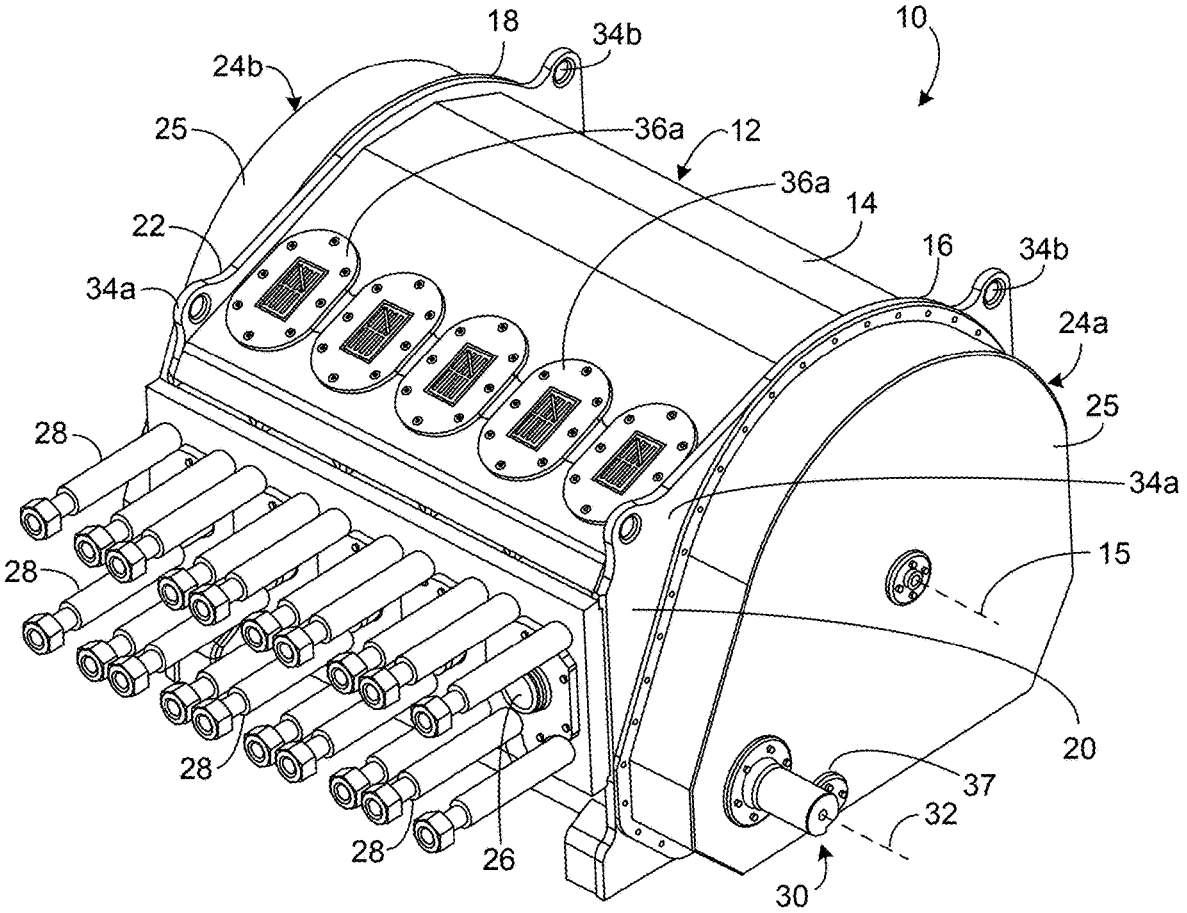
FIG. 1 PRIOR ART
FIG. 1 is an upper perspective view of a prior art hydraulic fracturing pump.
Figure 2:
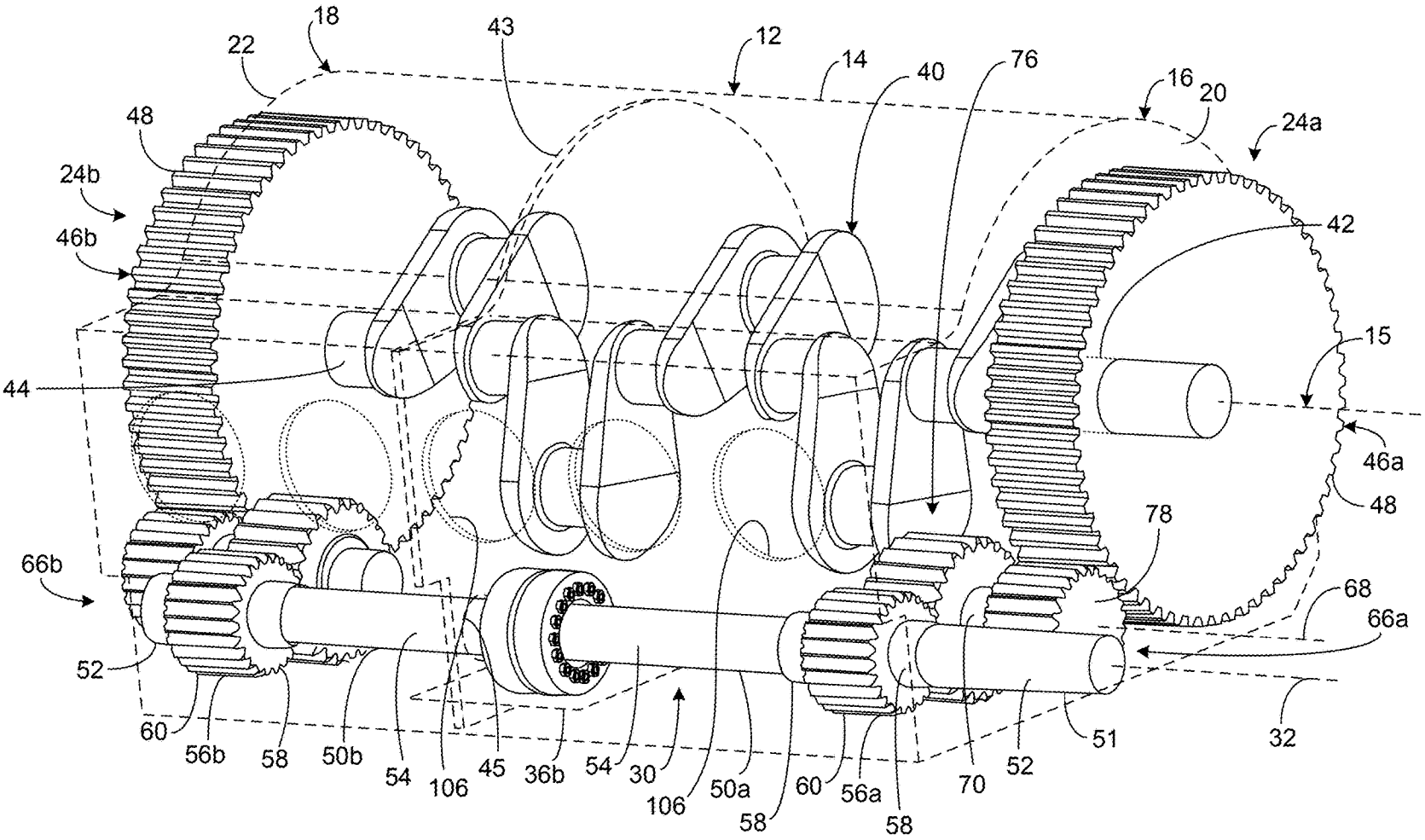
FIG. 2 PRIOR ART
FIG. 2 is a view of the mechanisms within the hydraulic fracturing pump of FIG. 1 of the prior art.
Figure 3:
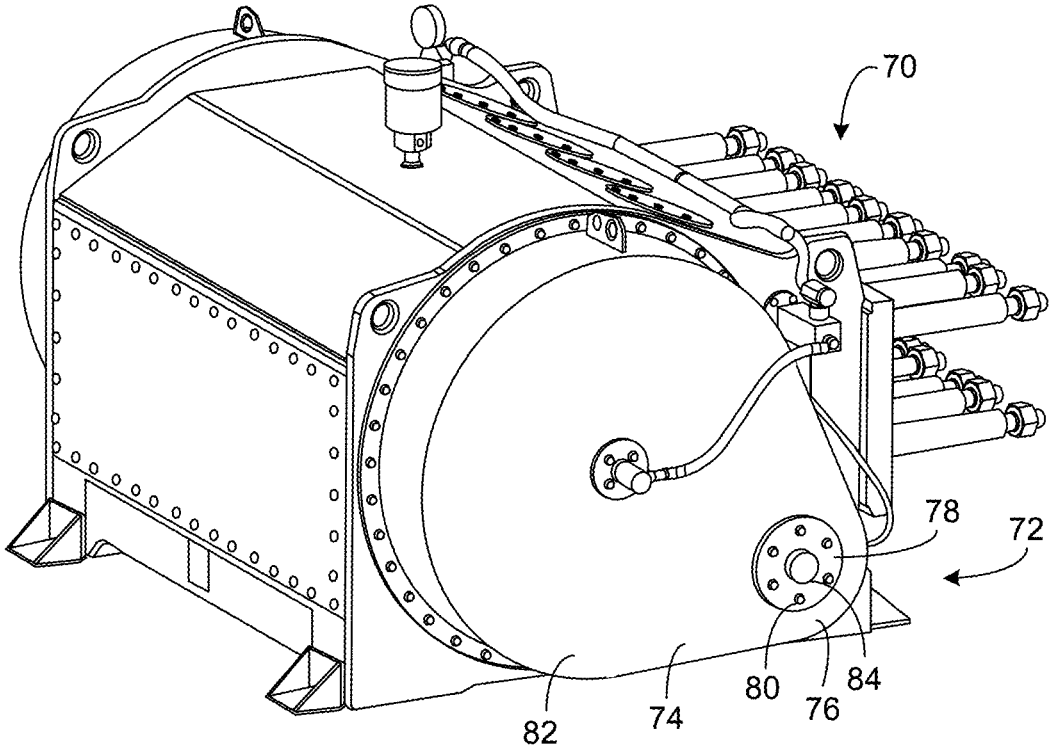
FIG. 3 is a perspective view showing the fracturing pump pinion rotation assembly as secured to the fracturing pump of the present invention.

As shown in FIG. 3, there is a hydraulic fracturing pump 70 to which the pinion rotation assembly 72 of the present invention can be applied. The fracturing pump pinion rotation assembly 72 is illustrated as mounted to a non-drive side 74 of the hydraulic fracturing pump 70. FIG. 3 further shows that the fracturing pump pinion rotation assembly 72 of the present invention will be generally secured to the pinion shaft adjacent a lower end 76 of the hydraulic fracturing pump 70. In particular, the fracturing pump pinion rotation assembly 72 will include a cover 78 that is secured by fasteners 80 to the wall 82 of the non-drive side of the fracturing pump 70. A cap 84 will overlie an opening in an annular portion of the cover 78. The cap 84 can be removed or pivoted so as to expose the interior of the annular portion of the cover 78 and to allow access to the stem that allows for the pinion shaft to be manipulated such that a rotation of the stem causes a corresponding rotation of the pinion shaft. In FIG. 3, cap 84 is illustrated as extending over the opening of the cover 78.

Figure 4:
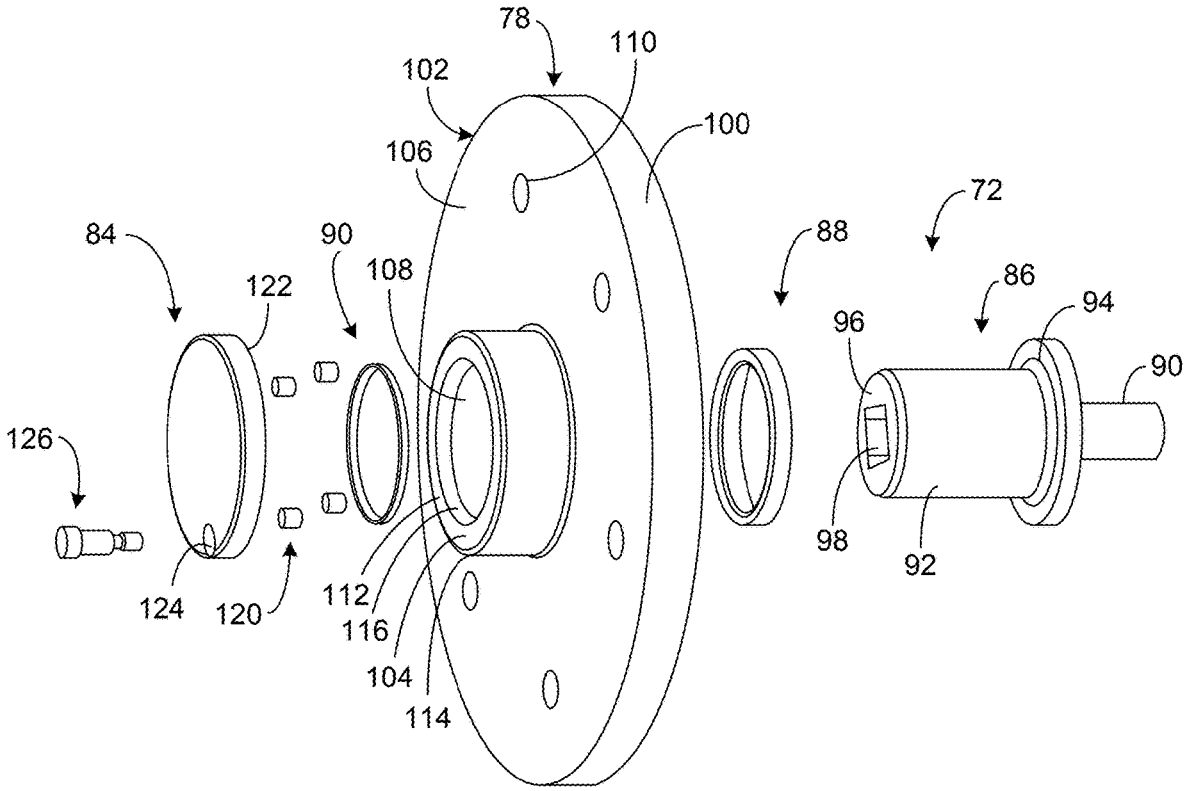
FIG. 4 is an exploded view of the fracturing pump pinion rotation assembly.

FIG. 4 is an exploded view showing the fracturing pump pinion rotation assembly 72 of the present invention. In particular, the fracturing pump pinion rotation assembly 72 includes the stem 86, a rotary seal 88, the cover 78, O-ring seals 90 and the cap 84. These components are assembled together so as to provide the fracturing pump pinion rotation assembly 72 of the present invention.

In FIG. 4, the stem 86 is illustrated as having a narrow diameter portion 90 and a wide diameter portion 92. A flange 94 is formed between the narrow diameter portion 90 and the wide diameter portion 92. The end 96 of the wide diameter portion 92 has a socket 98 formed therein. The socket 98, as illustrated, is a three-quarter inch square socket. However, within the present invention, the socket 98 can be in the form of an extension extending outwardly of the end 94 or it can be a socket of various geometric configurations and sizes. The narrow diameter portion 90 is adapted so as to engage with the end of the pinion shaft (to be described hereinafter). As shown in FIG. 4, the narrow diameter portion 90 is a pin (without threads). If the interior of the pinion shaft is threaded, then the narrow diameter portion 90 of the stem 86 can be suitably threaded so as to engage with the threads of the pinion shaft.

The rotary seal 88 will bear against the flange 94 of the stem 86 so as to allow the stem 86 to be rotatable in sealed relationship with the cover 78 and with the wall 82 of the non-drive side 74 of the hydraulic fracturing pump 70. As will be described hereinafter, the rotary seal 88 can be received within a notch formed in the surface of the cover 78.

The cover 78 has a discoidal portion 100 having an outer periphery 102. An annular portion 104 extends outwardly of the surface 106 of the discoidal portion 100. Annular portion 104 includes an opening 108 formed centrally therein. The opening 108 is adapted to receive the wide diameter portion 92 of the stem 86 therein. As such, once installed, the wide diameter portion 92 of the stem 86 will be exposed at the opening 108. A plurality of holes 110 are formed radially outwardly of the annular portion 104. These holes 110 are adapted to receive the fasteners 80 (shown in FIG. 3) so as to allow the cover 78 to be secured to the wall 82 of the non-drive side 74 of the hydraulic fracturing pump 70.

The annular portion 104 has an end the surface 112. End surface 112 is generally planar and includes a bolt hole 114 therein. A notch 116 is formed adjacent to the end 112. Notch 106 is adapted to receive the O-ring seal 90 therein.

FIG. 4 shows that there are a plurality of magnets 120 that are positioned between the cap 84 and the end 112 of the annular portion 104. These magnets 120 can be placed upon, or adjacent to, the end 112 or placed on or adjacent to the inner surface 122 of the cap 84. In normal use, the magnets 120 will be arranged in spaced relationship around the surfaces and serve to magnetically secure the cap 84 over the opening 108. As such, the magnets 120 will allow a user to maintain the cap 84 over the opening 108 or to release the cap 84 from the opening 108 so as to expose the socket 98 at the end 96 of the wide diameter portion 92 of stem 86.

The cap 84 has a bolt hole 124 formed adjacent a periphery thereof. Shoulder bolt 126 will extend through the bolt hole 124 and be engaged with the bolt hole 114 at the end 112 of the annular portion 104 of the cover 78. As such, the cap 84 will cover the opening 84 in one position or can rotate about the shoulder bolt 126 to rotate or pivot with respect to the shoulder bolt 126 so as to expose the opening 108.

Figure 5:
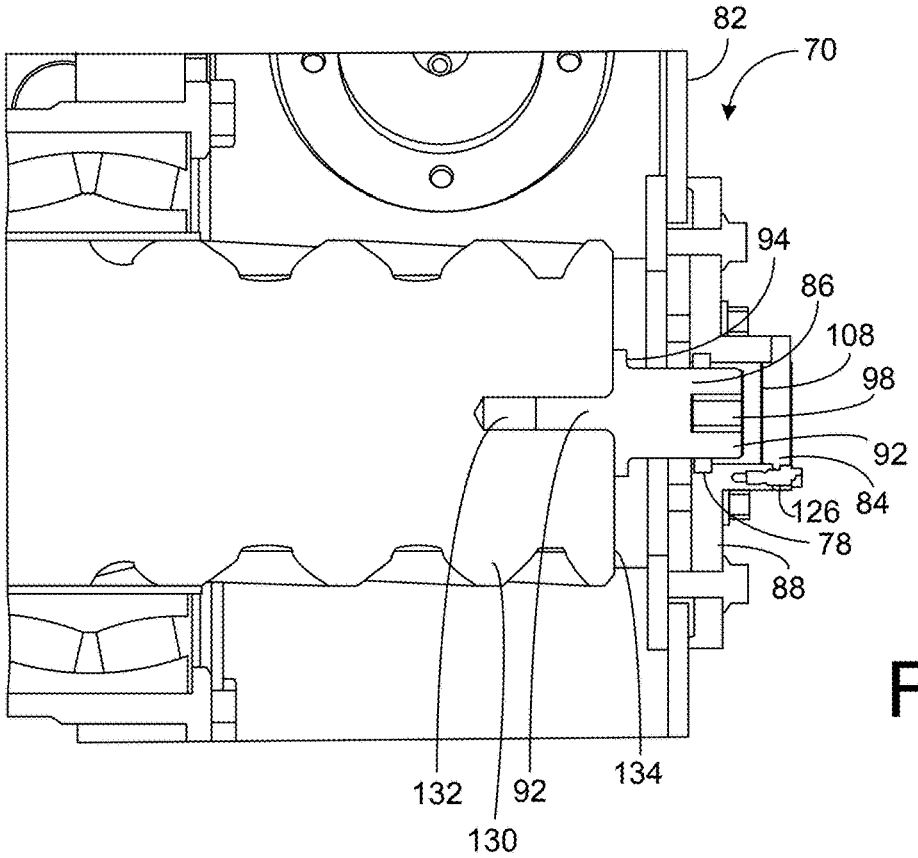
FIG. 5 is a cross-sectional view of the fracturing pump pinion rotation assembly of the present as applied to the pinion shaft of the fracturing pump.

FIG. 5 illustrates the assembly shown in FIG. 4 as used in association with the pinion shaft 130 of the hydraulic fracturing pump 70. The pinion shaft 130 has a receptacle 132 at end 134 thereof. Receptacle 132 can be either threaded or non-threaded. The narrow diameter portion 92 of stem 86 is received within the aperture 132. The wide diameter portion 92 of the stem 86 will extend outwardly from the end 134 of the pinion shaft 130. The flange 94 is illustrated as bearing against the end 134 when the narrow diameter portion 92 is installed within the aperture 132. The wide diameter portion 92 extends into the opening 108 of the cover 78. The socket 98 also faces outwardly of the wall 82 of the non-drive side of the hydraulic pump 70.

FIG. 5 shows that the cap 84 is pivoted about the bolt 126 so as to close the opening 108. As such, the socket 94 will avoid any introduction of foreign materials or debris. This will maintain the end of the stem 86 in a closed environment. The magnets (described herein previously) will secure the cap 84 in this closed position. The rotary seal 88 will allow the wide diameter portion 92 of the stem 86 to rotate with respect to the wall 82 of the non-drive side of the hydraulic fracturing pump 70.

Figure 6:
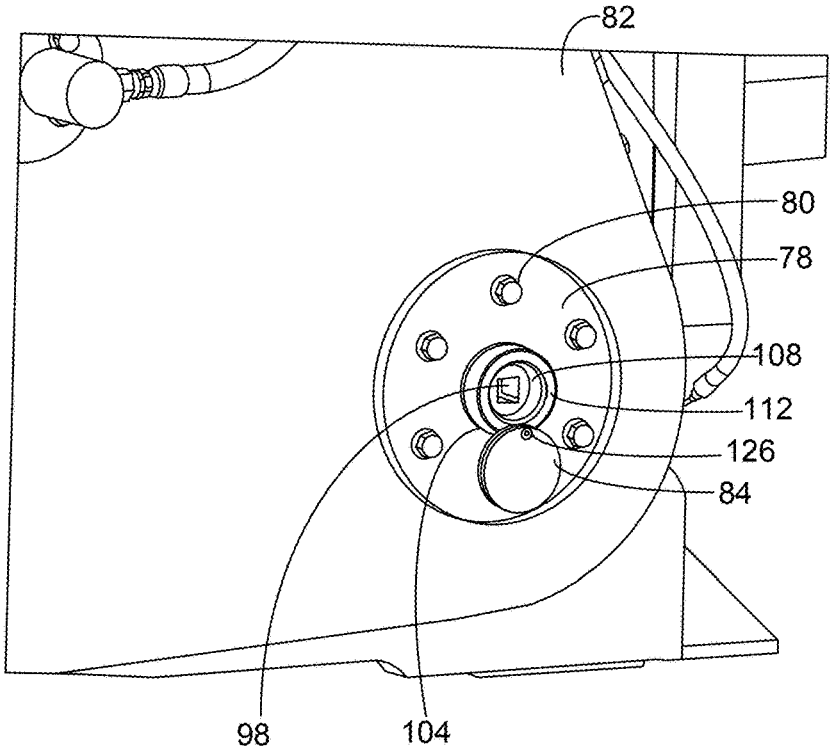
FIG. 6 is a perspective view, in close detail, of the fracturing pump pinion rotation assembly of the present invention as applied to the fracturing pump.

FIG. 6 illustrates the movement of the cap 84 to its open position. As can be seen, the cap 84 is pivoted about shoulder bolt 126. This is accomplished by pulling the cap 84 away from the magnets 120 and then allowing the cap 84 to drop and rotate. In an alternative embodiment of the present invention, the cap 84 can simply be lit lifted and removed from the end 112 of the annular portion 104. In either of the embodiments, the interior 108 of the annular portion 104 of the cover 78 is exposed.

In FIG. 6 shows that the socket 98 is exposed when the cap 84 is rotated to this position. As such, a worker can utilize a tool, such as a wrench or a ratchet, to rotate the stem 86. Since the stem 86 is affixed to the pinion shaft 130 (as illustrated in FIG. 5), the rotation of the stem 86 (as a result of the use of a wrench or ratchet in the socket 98) will cause a corresponding rotation of the pinion shaft 130.

After use, the wrench or ratchet tool can simply be removed from the socket 98. The cap 84 can then be rotated so as to overlie the opening 108 and reside in magnetically-secured relation with the end 112 of the annular portion 104 of the cover 78.

FIG. 6 further shows that the discoidal portion 100 of the cover 78 is affixed by fasteners 80 to the wall 82 of the non-drive side of the hydraulic fracturing pump 70.

Figure 7A:
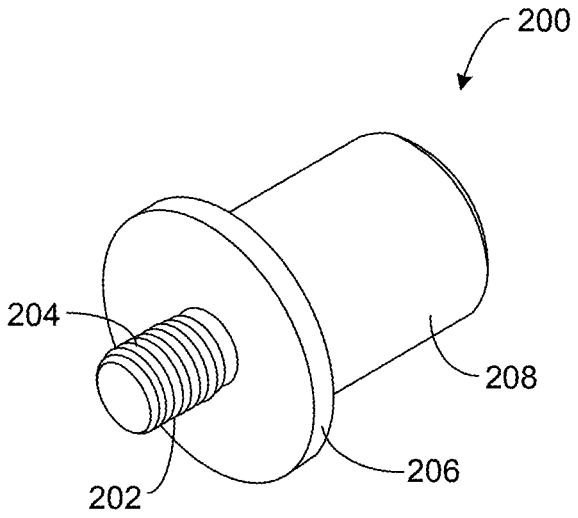
FIG. 7A is a bottom perspective view of the stem of the fracturing pump pinion rotation assembly of the present invention.
Figure 7B:
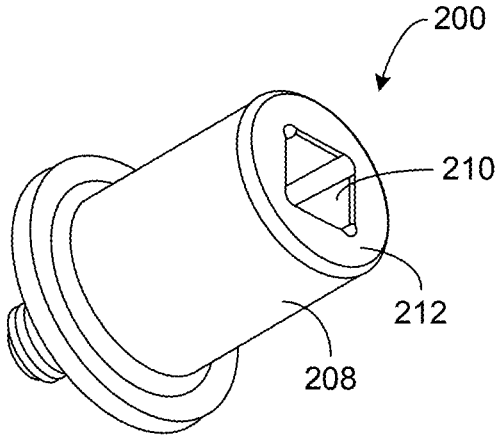
FIG. 7B is an upper perspective view of one embodiment of the stem of the fracturing pump pinion rotation assembly of the present invention.

FIGS. 7A and 7B show lower and upper views, respectively, of a stem 200 of one embodiment of the present invention. In FIG. 7A, the narrow diameter portion 202 has external threads 204 formed thereon. A flange 206 is formed between the narrow diameter portion 202 and the wide diameter portion 208. The external threads 204 will engage with the internal threads formed in the aperture 132 of the pinion shaft 130.

FIG. 7B shows that there is a socket 210 formed in the end of 212 of the wide diameter portion 208 of the stem 200. The socket 204 is a square socket that is adapted to receive a square tool therein. Alternatively, within the concept of the present invention, an extension can be used in place of the socket 210 so that a wrench, or similar tool, can be used so as to achieve the necessary rotation.

Figure 8A:
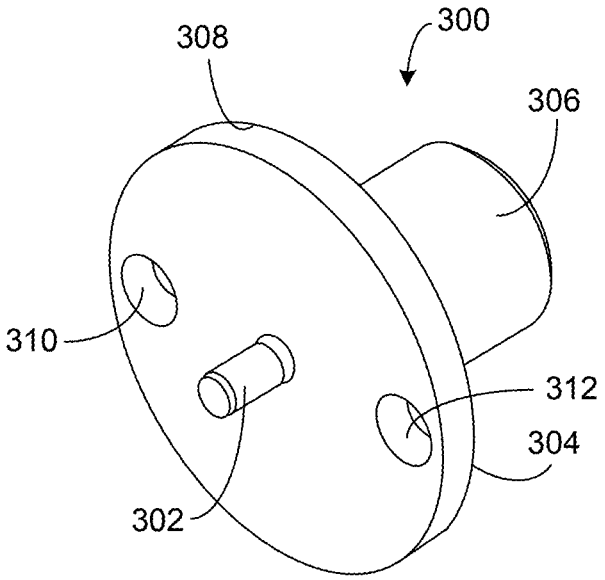
FIG. 8A is a bottom perspective view of an alternative embodiment of the stem of the fracturing pump pinion rotation assembly of the present invention.

FIG. 8A shows an alternative embodiment of the stem 300 as used in the present invention. The stem 300 includes a narrow diameter portion 302, a flange 304 and a wide diameter portion 306. The narrow diameter portion 302 is simply a pin that is inserted into the aperture 132 of the pinion shaft 130. In order to achieve sufficient rotation, the discoidal portion 308 of the stem 300 includes holes 310 and 312. Suitable fasteners can extend through the holes 310 and 312 so as to affix the stem 300 to the end of the pinion shaft 130.

Figure 8B:
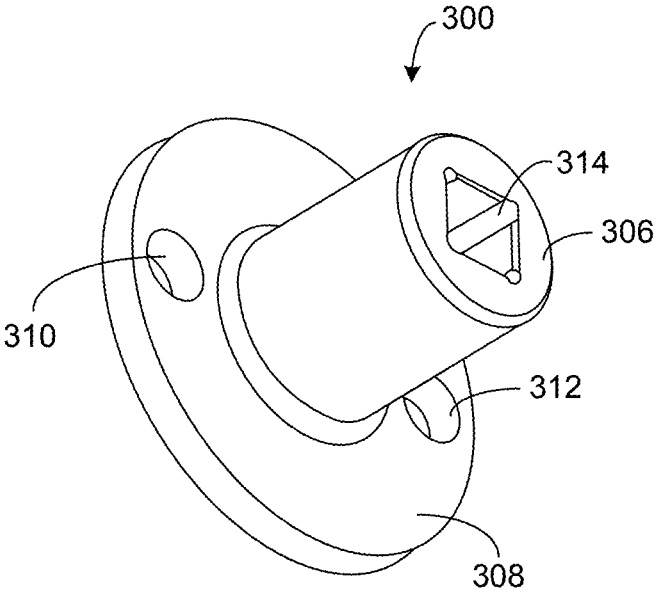
FIG. 8B is an upper perspective view of the alternative embodiment of FIG. 8A of the stem of the fracturing pump pinion rotation assembly of the present invention.

FIG. 8B illustrates the opposite end of the stem 300. As can be seen, the wide diameter portion 306 has a socket 314 formed therein. The holes 310 and 312 are illustrated as extending through the thickness of the flange 308.

The present invention utilizes a stem that engages with the pinion shaft, along with a cover that houses a rotary seal. The cover has a magnetic cap with the O-ring seal. The cover attaches in place over the pinion access port of the pump's non-drive side bull gear cover. The stem has, in the preferred embodiment, a three-quarter inch square drive socket at an end that can be engaged with a wrench or ratchet. The stem is either threaded or bolted to the non-drive side of the pinion shaft of the pump. The threaded-style stem will center itself in the lifting eye hole of the pinion shaft. The bolt-on stem would use a centering lug.

To use the assembly of the present invention, the operator will pull on the cap until the magnets release. The cap is then released so that it swings down on the shoulder bolt. The operator can then insert a three-quarter inch square drive extension in the tool and can turn the pump using a ratchet or other tool that engages with the square drive.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

We claim:

1. A fracturing pump pinion rotation assembly comprising:

a stem having a portion adapted to be threaded to a non-drive side of a pinion shaft, said stem having a socket or an extension adapted to be manipulated by a tool such that a rotation of the stem causes a corresponding rotation of the pinion shaft; and a cover having an opening therein, said cover adapted to be affixed to a wall of the non-drive side of a fracturing pump, the opening overlying the socket or extension of said stem such that the socket or extension is accessible from an exterior of the fracturing pump, said cover having an annular portion extending outwardly away from the wall of the non-drive side of the fracturing pump, further comprising:

a cap removably or pivotally connected to an end of the annular portion of said cover, said cap being movable between a first position covering the opening of the annular portion and a second position exposing the socket or extension of said stem through the opening of the annular portion of said cover the opening of said cover being defined by an interior of the annular portion of said cover, wherein said cap is pivotally connected to the end of the annular portion of said cover, said cap being slidable along a bolt secured to the annular portion of said cover so as to separate from the annular portion of said cover.

2. The fracturing pump pinion rotation assembly of claim 1, the annular portion of said cover having a bolt hole formed at an end thereof, the cap having a bolt hole formed adjacent a periphery of said cap, the fracturing pump pinion rotation assembly further comprising:

a shoulder bolt extending through the bolt hole of said cap and affixed within the bolt hole of the annular portion of said cover.

3. The fracturing pump pinion rotation assembly of claim 2, said cap being pivotable around said shoulder bolt so as to move between the first position and the second position.

4. The fracturing pump pinion rotation assembly of claim 3, further comprising:

a magnet affixed to either a surface of said cap that faces the annular portion of said cover or to the end of the annular portion of said cover, said magnet adapted to releasably affix said cap over the opening of the annular portion of said cover.

5. The fracturing pump pinion rotation assembly of claim 4, said magnet comprising a plurality of magnets arranged in spaced relation to each other around the surface of said cap.

6. The fracturing pump pinion rotation assembly of claim 4, said magnet comprising a plurality of magnets arranged in spaced relation at the end of the annular portion of said cover.

7. The fracturing pump pinion rotation assembly of claim 1, further comprising:

an O-ring seal positioned between said cap and the annular portion of said cover, said O-ring seal adapted to seal the opening of the annular portion of said cover.

8. The fracturing pump pinion rotation assembly of claim 1, said stem having a narrow diameter portion and a wide diameter portion with a flange formed between the narrow diameter portion and the wide diameter portion.

9. The fracturing pump pinion rotation assembly of claim 1, said cover having a discoidal portion, wherein the opening is formed centrally through the discoidal portion, the discoidal portion having a plurality of holes formed in spaced relation radially outwardly of the opening of said cover, the fracturing pump pinion rotation assembly further comprising: a plurality of fasteners extending through the plurality of holes and engaging with the wall of the non-drive side of the fracturing pump.

10. The fracturing pump pinion rotation assembly of claim 1, wherein the socket or extension is a drive socket.

11. The fracturing pump pinion rotation assembly of claim 10, wherein the drive socket is adapted to be engageable with the tool, the tool being a wrench or a ratchet.

12. A fracturing pump pinion rotation assembly comprising:

a stem having a portion adapted to be threaded to a non-drive side of a pinion shaft, said stem having a socket or an extension adapted to be manipulated by a tool such that a rotation of the stem causes a corresponding rotation of the pinion shaft; and a cover having an opening therein, said cover adapted to be affixed to a wall of the non-drive side of a fracturing pump, the opening overlying the socket or extension of said stem such that the socket or extension is accessible from an exterior of the fracturing pump, said stem having a narrow diameter portion and a wide diameter portion with a flange formed between the narrow diameter portion and the wide diameter portion, the narrow diameter portion having an end opposite the wide diameter portion adapted to engage with the pinion shaft.

13. The fracturing pump pinion rotation assembly of claim 12, the wide diameter portion of said stem extending away from the pinion shaft, the flange bearing against an end of the pinion shaft.

14. The fracturing pump pinion rotation assembly of claim 13, the wide diameter portion of said stem extending into the opening of said cover.

15. The fracturing pump pinion rotation assembly of claim 14, further comprising:

a rotary seal interposed between the wide diameter portion of said stem and the wall of the non-drive side of the fracturing pump, said rotary seal adapted to allow the stem to rotate in relation to the wall of the non-drive side of the fracturing pump.

16. A fracturing pump pinion rotation assembly comprising:

a stem having a portion adapted to be threaded to a non-drive side of a pinion shaft, said stem having a socket or an extension adapted to be manipulated by a tool such that a rotation of the stem causes a corresponding rotation of the pinion shaft; and a cover having an opening therein, said cover adapted to be affixed to a wall of the non-drive side of a fracturing pump, the opening overlying the socket or extension of said stem such that the socket or extension is accessible from an exterior of the fracturing pump, said stem having a narrow diameter portion and a wide diameter portion with a flange formed between the narrow diameter portion and the wide diameter portion, wherein the narrow diameter portion of said stem is threaded.

* * * * *